United States Patent [19]

Heng et al.

[11] Patent Number: 4,904,204

[45] Date of Patent: Feb. 27, 1990

[54] INSULATION-PIERCING CONNECTOR FOR COAXIAL CABLES

[75] Inventors: Jean-Paul Heng, Lyon; André Marmonier, Bron; Henri Guernet, Lyon, all of France

[73] Assignee: CGEE Alsthom, Levallois Perret, France

[21] Appl. No.: 242,995

[22] Filed: Sep. 12, 1988

[30] Foreign Application Priority Data

Sep. 11, 1987 [FR] France ..... 87 12605

[51] Int. Cl.[4] ..... H01R 4/24

[52] U.S. Cl. ..... 439/425; 439/63; 439/578; 439/394

[58] Field of Search ..... 439/98, 99, 578–585, 439/675, 394–397, 425, 426, 63

[56] References Cited

U.S. PATENT DOCUMENTS

| | | | |
|---|---|---|---|
| 2,615,948 | 10/1952 | Kamen . | |
| 2,805,399 | 9/1957 | Zeeper | 439/582 |
| 4,120,554 | 10/1978 | Bianchi | 439/394 |
| 4,437,722 | 3/1984 | Bianchi | 439/394 |
| 4,691,976 | 9/1987 | Cowan | 439/394 |

FOREIGN PATENT DOCUMENTS

| | | | |
|---|---|---|---|
| 581405 | 8/1959 | Canada | 439/394 |
| 109229 | 5/1984 | European Pat. Off. | 439/394 |
| 2566968 | 1/1986 | France | 439/394 |
| 2600217 | 12/1987 | France . | |

*Primary Examiner*—David Pirlot
*Attorney, Agent, or Firm*—Sughrue, Mion, Zinn, Macpeak & Seas

[57] ABSTRACT

An insulation-piercing connector for coaxial cables comprises a base member and a complementary bracket member together defining a conduit for a coaxial cable. The base member and the bracket member are adapted to be separated to fit around a coaxial cable and to be clamped together to immobilize the coaxial cable in the conduit. The base member is also adapted to enable it to be attached to a support. A bearing surface on the base member bears on the support when the base member is attached to the support. Terminals on the base member project beyond the bearing surface. Connecting spikes project from the base member and pierce the coaxial cable to connect its inner and outer conductors to respective terminals. A guide transverse to the conduit opens into the conduit and externally of the base member. The connecting spike adapted to connect the inner conductor of the coaxial cable to the respective terminal is removably housed in this guide. An inner conductor connecting spike locating guide on the base member is disposed obliquely to the bearing surface and opens externally of the base member above the bearing surface and laterally of the bracket member. The inner conductor connecting spike can therefore be inserted and removed even when the connector is attached to a support by its base member.

8 Claims, 5 Drawing Sheets

INSULATION-PIERCING CONNECTOR FOR COAXIAL CABLES

BACKGROUND OF THE INVENTION

1. Field of the Invention

The invention concerns an insulation-piercing connector for coaxial cables adapted to be mounted on a support on equipment to be served by the cable or on a plug or socket connector, either before or after connection to the coaxial cable, and to provide a branch connection, possibly without any intermediary member, between the circuitry of the equipment and the coaxial cable.

2. Description of the Prior Art

The increase in use of coaxial cables for interconnecting transmitting and/or receiving equipment, in local area networks comprising multiple stations, for example, has led to the development of insulation-piercing connectors for connecting equipments in parallel along a common, shared cable.

In many cases, and especially in networks where the configuration is likely to change, there is a requirement to preserve the integrity of the cable to the greatest possible degree, which means avoiding the use of removable Tee branching connections, as these make it necessary to divide up the cable and to provide it with plug-in sockets for the connectors, or connectors which require notching the cable at the location of the insulation-piercing connectors to obtain access to the core.

In either case the operation on the cable is irreversible and therefore usually a problem in the event of reconfiguration.

To avoid this disadvantage insulation-piercing connectors have been proposed in which the branch connection is made by connecting spikes which penetrate the coaxial cable transversely, through the protective sheath covering it, to become embedded either in the tubular outer conductor or in the central core.

The core connecting spike, usually called the "probe", is generally covered by an insulator at least in the part that is designed to penetrate the cable and excluding its end at which it is embedded in the core of the cable. This insulator is designed to eliminate the risk of the probe short-circuiting the cable, especially where the outer conductor is formed by a tubular braid of conductive wires.

To minimize the damage to the coaxial cable by the connecting spikes the dimensions of the part of the spikes which penetrates the cable are minimized. A compromise has to be arrived at to enable the spikes to withstand the forces exerted on them when the connector is mounted on the cable and in particular when they penetrate the cable.

It is known to pre-pierce holes in the cable at the locations provided for the connectors in order to facilitate penetration of the probes to the cable core, which enables the diameter of the probes to be reduced commensurately.

The pre-pierced hole for a probe is preferably made after the cable has been finally positioned and immobilized in the connector, and the conduit through which the probe is inserted and in which it is immobilized is used to form the pre-pierced hole. This solution makes it possible to exploit the piercing guide that this conduit can form and to avoid trial and error placing of the probe which would result from piercing the cable before immobilizing it in the connector.

It is also known to associate with the probe a spring device which presses its end against the core that it penetrates, in order to ensure that the contact established between the probe and the core remains constant with time.

The solutions described hereinabove, used in the disclosure of European patent No. 0109229 in particular, are also used in the embodiment described in this application, one objective of which is to propose a secure and reliable insulation-piercing connector that is simple to manufacture and install and causes virtually no damage to the cable.

Another objective of the present invention is to propose an insulation-piercing connector adapted to be positioned on a support on equipment to be served by the cable or on a plug or socket attached to the cable either before or after the connection is made to the coaxial cable.

Positioning the probe after pre-piercing the cable implies mounting the connector onto the cable before the connector is fixed to its support and electrically connected to the equipment to be served or to the plug or socket, when the probe is housed in the base member by which the connector is fixed and is inserted through an opening under this base member, that is to say in the surface of the latter which normally bears against the support.

The need to mount and connect a connector to a cable before mounting it on and connecting it to the user equipment is a disadvantage in various cases, for example if the equipment is provided with a fixed insulation-piercing connector designed to be connected to a coaxial cable only at the point of installation, as is the case with numerous equipments sold in cases without their external connecting cables.

Consequently, the present invention proposes an insulation-piercing connector for coaxial cables adapted to be mounted on a support on equipment served by the cable or on a plug or socket, either before or after connection to the coaxial cable, and optionally to provide a branch connection without any intermediary member between the electrical circuitry of the equipment and the coaxial cable.

SUMMARY OF THE INVENTION

The present invention consists in an insulation-piercing connector for coaxial cables comprising a base member and a complementary bracket member together defining a conduit for a coaxial cable, said base member and said bracket member being adapted to be separated to fit around a coaxial cable and to be clamped together to immobilize said coaxial cable in said conduit, said base member being also adapted to enable it to be attached to a support, a bearing surface on said base member which bears on said support when said base member is attached to said support, terminals on said base member projecting beyond said bearing surface, connecting spikes projecting from said base member adapted to pierce said coaxial cable and to connect inner and outer conductors of said coaxial cable to respective terminals, a guide transverse to said conduit and opening into said conduit and externally of said base member in which said connecting spike adapted to connect said inner conductor of said coaxial cable to the respective terminal is removably housed, and an inner conductor connecting spike locating guide on said base member disposed obliquely to said bearing surface and opening externally of said base member above said bearing surface and laterally of said bracket member, whereby said inner conductor connecting spike can be inserted and removed even when said connector is attached to a support by said base member.

The characteristics and advantages of invention will emerge from the following description given by way of non-limiting example only with reference to the appended diagrammatic drawings.

DESCRIPTION OF THE PREFERRED EMBODIMENTS

Figure 1:
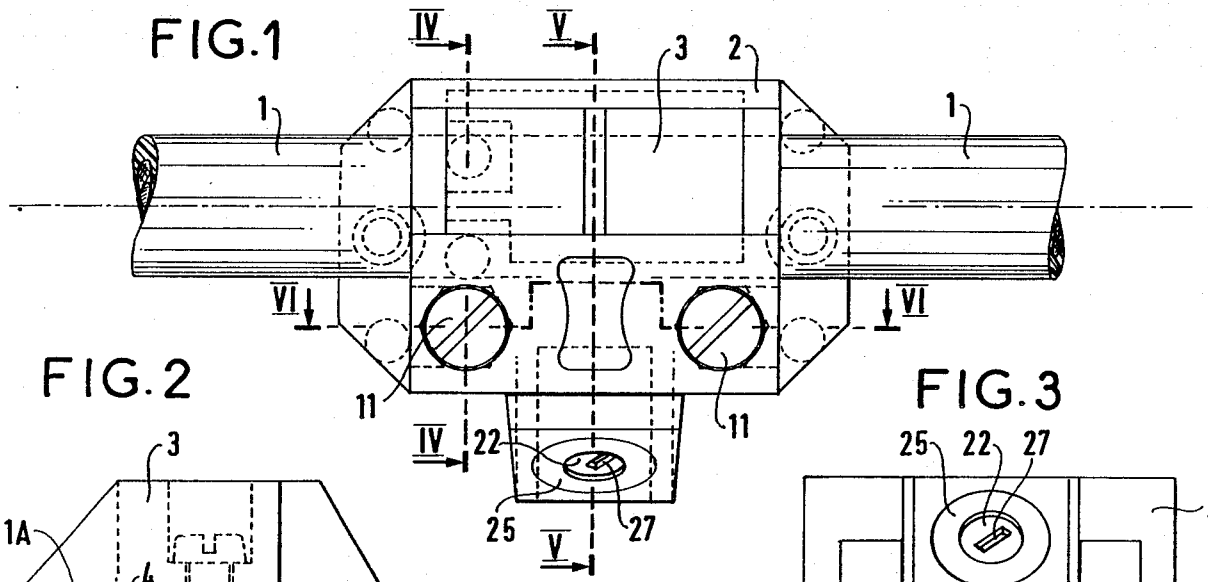
FIG. 1 is a top view of an insulation-piercing connector in accordance with the invention fitted to a cable.
Figure 3:
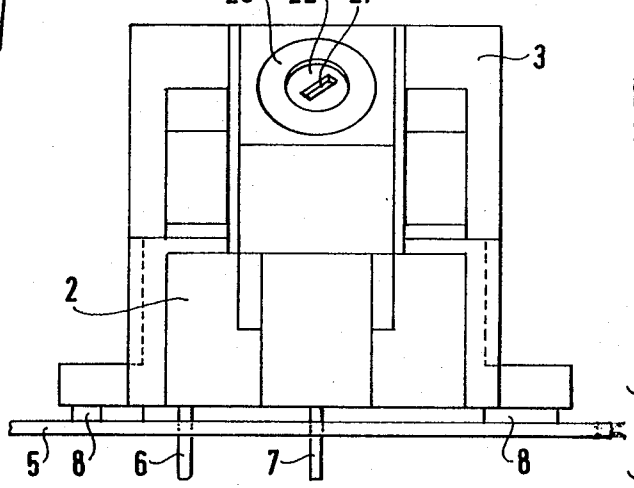
FIG. 3 is a front view of the connector from FIG. 1 mounted on a support.
Figure 2:
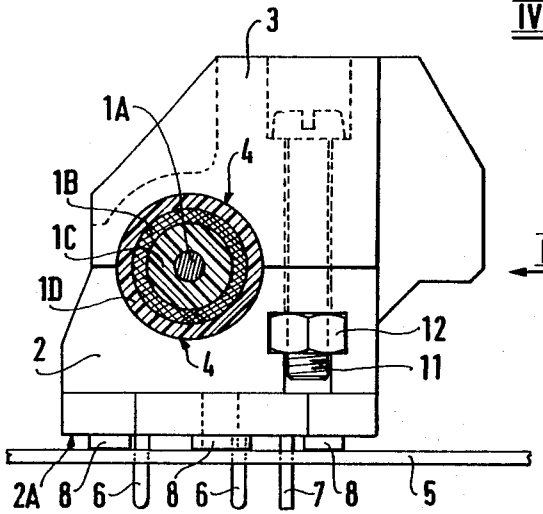
FIG. 2 is a lefthand view of the connector from FIG. 1 with the cable shown in cross-section.

The insulation-piercing connector shown in FIGS. 1 and 3 is designed to be fitted to a circular cross-section coaxial cable 1 to make a branch connection from this cable to a user equipment (not shown).

To this end the insulation-piercing connector comprises two complementary parts made from electrically insulative material, optionally metal-coated. Between them is formed a conduit 4 through which the coaxial cable can be passed and in which it is immobilized when the two complementary parts are fixed (clamped) to each other.

One of the complementary parts forms a base member 2 and enables the insulation-piercing connector to be placed on and fixed to a support 5.

The other part forms a bracket member 3 enabling the cable to be immobilized.

The support 5 is a plate, for example an electrically insulative plate carrying conductive tracks (not shown) and manufactured by known printed circuit production techniques, this plate optionally serving as a support for components of an electronic circuit.

The surface 2A through which the base member 2 bears on the support 5 carries connecting terminals 6, 7 for the spikes which connect the insulation-piercing connector to the coaxial cable 1.

The connecting terminals 6, 7 are pins for insertion into holes provided for this purpose in the support 5, for example plated-through holes enabling the pins to be soldered to the conductive tracks on the support 5 by wave soldering in the well-known way.

Figure 6:
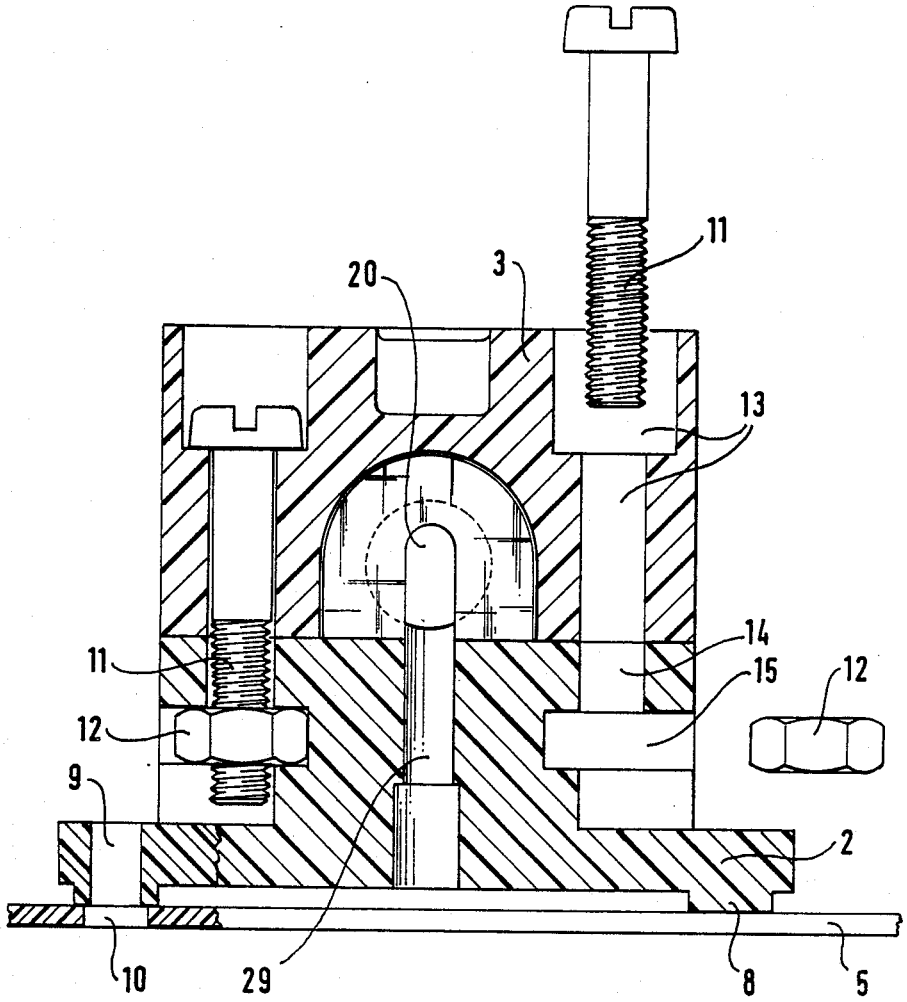
FIG. 6 is a cross-section on the line VI—VI in FIG. 1 showing the two complementary cable immobilizing parts of the connector.

Locating studs 8 on the bearing surface 2A of the base member 2 facing the support 5 separate the bearing surface 2A slightly from the support 5 on which it is placed and to which the connector is fixed, for example by conventional bolts (not shown) passing through the bottom part of the base 2 and the support 5 through appropriate holes such as the holes 9 and 10 (FIG. 6).

The cable conduit 4 (FIG. 1) is formed in the plane on which the complementary parts, that is the base member 2 and the bracket member 3, join and is parallel to the bearing surface 2A and consequently to the support 5 when the insulation-piercing connector is fixed to the support. This therefore immobilizes the coaxial cable 1 parallel to the support 5, where necessary.

The cable conduit 4 is formed by two half-conduits each in the form of a semicylindrical open channel in one of the complementary parts. The half-conduit in the base member 2 extends longitudinally across the base member 2 and is open when the bracket member 3 is removed, enabling the coaxial cable 1 to be placed in it, where it adopts a well-defined position because of its stiffness and the fact that its dimensions and those of the half-conduit match.

The bracket member 3 is placed on the base member 2 so that the half-conduit it comprises fits to the corresponding half-conduit of the base member and traps the coaxial cable 1 placed in it. The bracket member is attached to the base member 2 by nuts and bolts arranged as shown in FIG. 6.

Each fastening conventionally comprises a bolt 11 and a nut 12, the bolt passing through the bracket member 3 and part of the base member 2 by means of conduits 13, 14.

The conduit 13 opens externally of the connector, in the upper part of the bracket member, through an orifice of larger diameter than that which leads to the bearing surface of the base member 2 through their common joining plane. The conduit 14 starts at the joining plane and extends the conduit 13, opening into a cavity 15 provided laterally in the base member, on the axis of said conduit 14, for receiving a nut 12. This enables the bolts 11 to be inserted through the upper part of the connector and the nuts 12 to be inserted laterally into the base member 2 whether the base connector is fixed to its support or not.

Figure 4:
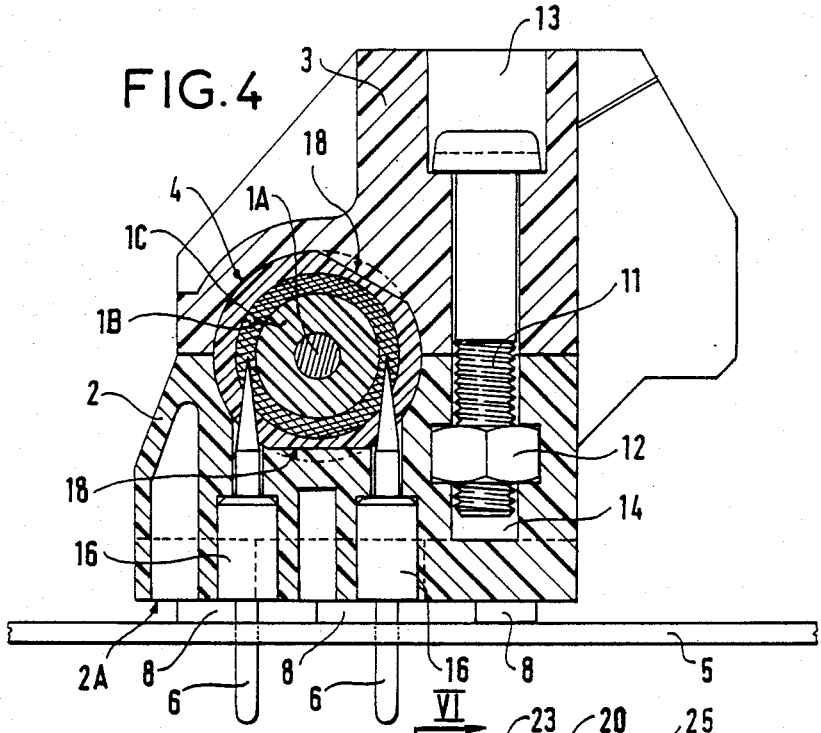
FIGS. 4 and 5 are respective transverse cross-sections on the lines IV—IV and V—V in FIG. 1 showing the connector mounted on a support.
Figure 5:
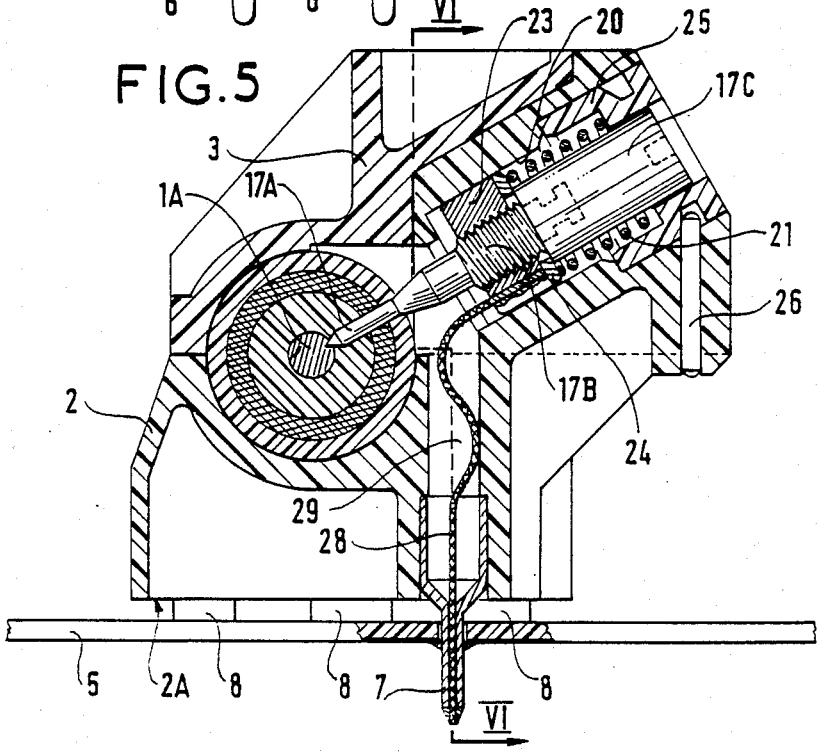

FIGS. 4 and 5 show in more detail the internal structure of the connector when connected to the coaxial cable 1 which comprises in the conventional way a solid conductive core 1A located at the center of a tubular outer conductor 1B from which it is separated by a solid insulator 1C. The tubular outer conductor 1B, generally of braided wires, is in turn covered with an insulative and protective sheath 1D.

As previously indicated, there pass through the surface 2A of the base member the connecting terminals 6, 7 for the connecting spikes 16 and a probe 17 designed respectively to contact the tubular outer conductor 1B and the core 1A of the coaxial cable 1, through the cable and transversely relative to it.

In this embodiment, a pair of connecting spikes 16 is disposed transversely to the coaxial cable immobilizing conduit in the half-conduit formed at the joining plane between the complementary parts in the base member. The two connecting spikes 16 of a pair are disposed symmetrically relative to the longitudinal median plane of the half-conduit. Pointed parts of them enter this half-conduit and are designed to penetrate the tubular outer conductor of the cable through the sheath, one on each side of the core.

The connecting spikes 16 are made from a hard material that is a good electrical conductor. They are force fitted or molded into the base member 2 so that their other ends, forming pins, project through the bearing surface 2A of the base member to enable optional direct soldering to conductive tracks carried by the support 5.

The coaxial cable is forced onto the connecting spikes 16 in the conduit of a connector when the cable is fitted into the half-conduit of the base member 2, after previously removing the bracket member 3.

Replacing the bracket member 3 on the base member and tighting the nuts and bolts 11, 12 immobilizes the coaxial cable in the conduit 4 after the connecting spikes penetrate the tubular outer conductor 1B, the length of and the distance between the spikes ensuring that they inevitably penetrate the latter.

Immobilization of the coaxial cable 1 is enhanced by the provision of flats 18 visible in FIG. 4 which oppose any movement of the cable in rotation or translation after tightening the nuts and bolts fastening the bracket member 3 to the base member 2.

As seen in FIG. 5, a single connecting spike or probe 17 is used to connect the core 1A of the coaxial cable to the insulation-piercing connector.

Figure 7:
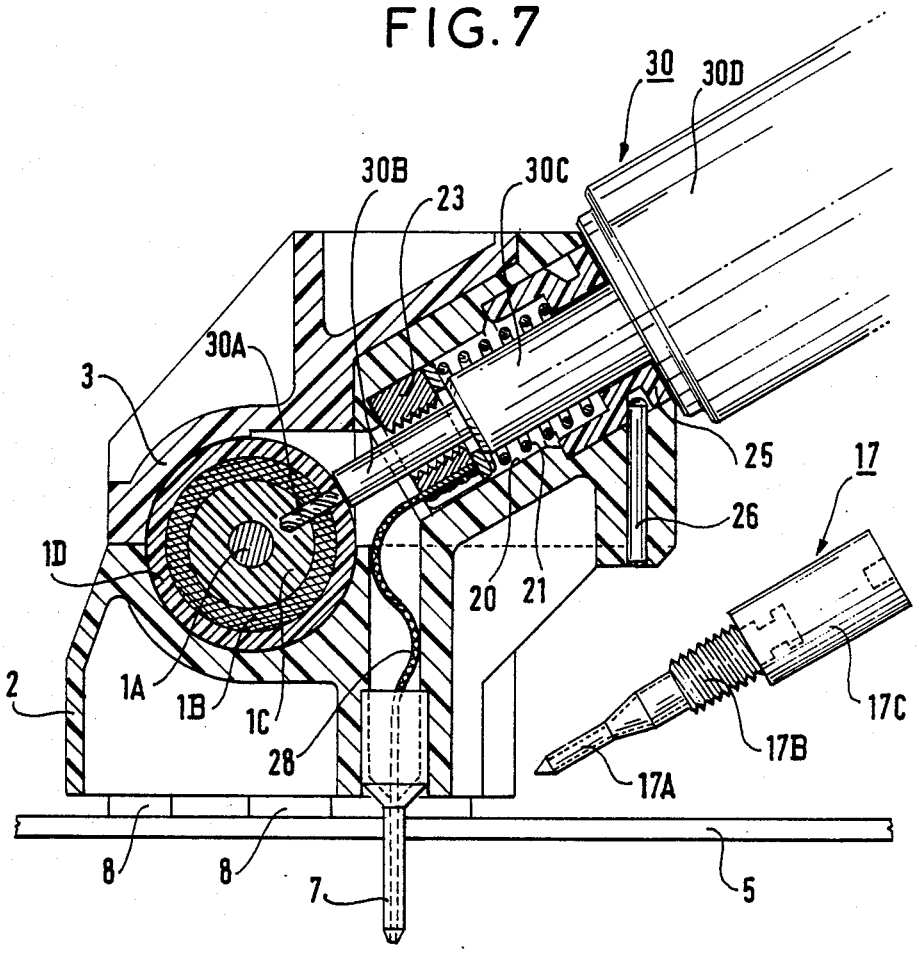
FIG. 7 shows an inner conductor connecting spike and a cable piercing tool associated with the connector as shown in FIG. 4, the inner conductor connecting spike here being withdrawn from the connector.

The probe 17 (FIG. 7) comprises a sharp spike 17A designed to penetrate into the material of the core 1A, this conductive metal spike being in the conventional way embedded, except for its sharp penetrating tip, in an insulator to prevent any contact between the part adapted to enter the cable and any other conductor.

A screwthread 17B serves to fix the probe into the base member 2, the latter comprising to this end a probe positioning guide 20 disposed transversely to the cable conduit and oriented obliquely relative to the bearing surface 2A of the base member 2. The positioning guide 20 opens into the conduit 4 and externally of the base member 2 above the bearing surface 2A and laterally relative to the bracket member 3 which covers the upper part of the connector when fitted. The positioning guide 20 opens obliquely level with the upper part of the insulation-piercing connector formed by the assembled base member 2 and bracket member 3, which makes it possible to insert or remove the probe 17 whether or not the connector is mounted on a coaxial cable 1 and/or on a support 5.

The positioning guide 20 also opens laterally into the conduit 4 in which the coaxial cable is immobilized, outside the area covered by the bracket member 3.

The probe 17 is of the spring-loaded type and a coil spring 21 that it carries is housed in the positioning guide 20 around an insulative material cylindrical head 17C fixed to the end of the screwthread 17B at the end opposite the spike 17A of the probe.

The screwthread 17B is received into a slider member 23 able to move in translation in a sideway which terminates the positioning guide 20 inside the insulation-piercing connector and which opens through a smaller part enabling insertion of the spike 17A into the conduit 4.

One end of the spring 21 bears against the slider member 23, via a bearing washer 24, and its other end bears against a tubular abutment member 25 immobilized at the external opening of the positioning guide 20, for example by means of a circlip (not shown) inserted into a circular groove at the opening of the guide or by a key 26 fixed into the base member. The cylindrical head 17C passes through the tubular abutment member 25 relative to which it is able to move in rotation and to some degree in translation. A drive coupling recess 27 is provided at the end of the cylindrical body accessible from the outside through the tubular abutment 25, for screwing the probe in and out.

A conductor member 28 in the form of a flexible wire or braid connects the slider member 23, which is made from a metal that is a good conductor of electricity, to the connecting terminal 7 projecting from the bearing surface 2A of the base member 2.

The connecting terminal 7 is of the hollow tubular type to enable the braid to be inserted into the terminal before it is fixed to it by soldering. The terminal is fixed at the end of a conductor member conduit 29 provided in the base member between the inside end of the positioning guide 20 and the bearing surface 2A.

The probe is inserted into the coaxial cable 1 after the latter is immobilized between the base member and the bracket member of the connector and after the cable is pierced using a rotary piercing tool 30 comprising a cutting tool 30A projecting from a toolholder 30B-30C.

The cutting tool 30A projecting out of the toolholder 30B-30C has a length slightly less than the radius of a transverse cross-section of the coaxial cable so that it penetrates the solid insulation 1C of the cable through the protective sheath 1D and the tubular outer conductor 1B without reaching the core 1A.

The tool 30A is adapted to make a hole the same diameter as the sharp spike 17A of the probe. It is introduced through the tubular abutment member 35, the spring 21 and the slider member 23, the assembly formed by the spike 17A of the probe, the screwthread 17B and the cylindrical body 17C being at this time removed from the connector. The toolholder 30B-30C is in two consecutive parts of different diameter, the part 30B which actually carries the tool having a diameter less than that of the screwthread provided in the slider member 23 for the screwthread 17B so as to enable unimpeded penetration and rotation of the part 30B in the screwthread when piercing the coaxial cable. The part 30C has a diameter corresponding to the inside diameter of the central hole formed in the tubular abutment member 35 for the cylindrical body 17C of the probe so as to use this central hole as a piercing guide.

Piercing is performed in the conventional way by forcing in and turning the cutting tool 30A using the tool body 30D until this body butts up against the tubular abutment member 25.

After removing the cutting tool from the tubular abutment member 25 the assembly comprising the spike 17A of the probe, the screwthread 17B and the cylindrical body 17C is introduced into the positioning guide 20 and the tubular abutment member 25.

The assembly comprising the spike 17A of the probe, the screwthread 17B and the cylindrical body 17C is screwed into the slider member 23 by means of a screwdriver (not shown) inserted into the drive coupling recess 27. This drives the slider member through the bottom of the positioning guide and the probe into the cable until its spike 17 penetrates the core 1A, after piercing right through the solid insulation due to the force applied by the screwdriver.

When the spike 17 of the probe bears on the core of the cable the slider member 23 is caused to rise along the screwthread 17B and compress the spring 21 between the slider member and the tubular abutment member 25. As a result, the spike bears on the core with constant pressure, in particular should the insulation-piercing connector be subject to vibration.

The equipment served by the cable can be taken out of service by partially unscrewing the assembly comprising the probe, screwthread and cylindrical body, until the spike of the probe is separated from the core.

Demounting the connector by removing the probe, the bracket member and the base member leaves the coaxial cable practically intact.

The insulation-piercing connector in accordance with the invention may also be fitted to a cable for subsequent connection of its probe, for example during commissioning. In this case the cable is placed between the two complementary parts, the base member being optionally fitted already to its support. The coaxial cable is not pierced to insert the probe until the latter is to be connected.

An alternative embodiment of the insulation-piercing connector in accordance with the invention, which has been described mounted on a plane equipment support of the printed circuit board type, for example, can also be fitted to a standard coaxial plug or socket to enable the connection of a branch coaxial cable to the cable to which the insulation-piercing connector proper is fitted.

Figure 8:
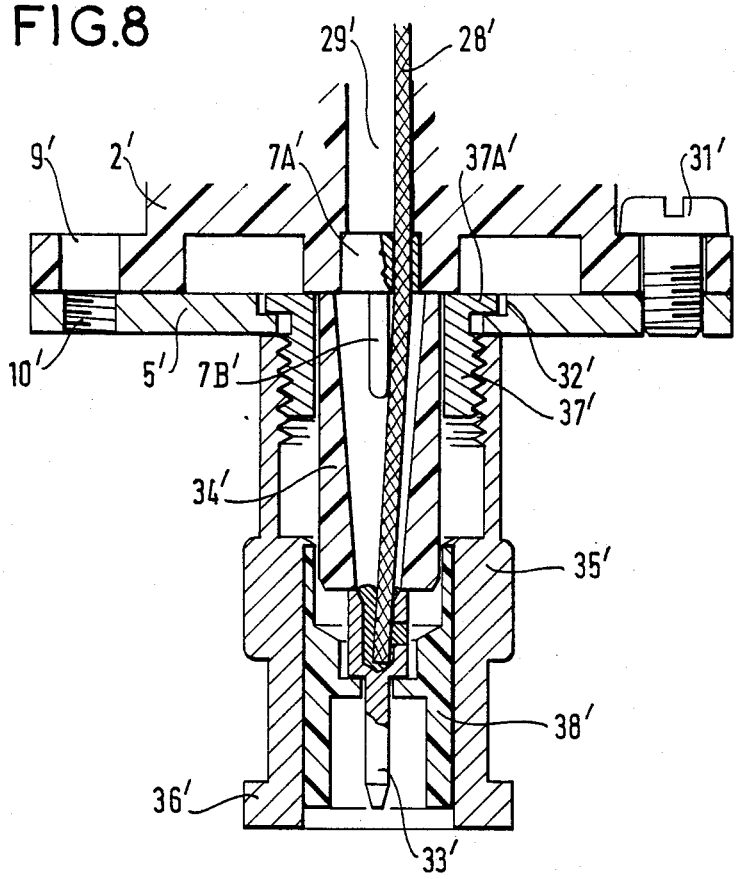
FIG. 8 is a partial view in cross-section of an alternative embodiment of the connector attached to a coaxial plug on a common support.

To this end the base member 2' of the insulation-piercing connector, only the bottom part of which is shown in FIG. 8, is placed against a plane support surface 5' formed by a metal plate that is a good conductor of electricity. The latter includes holes 10' aligned with the holes 9' in the base member 2' to enable the base member to be fixed to the support by screws such as the screw 31' or by nuts and bolts (not shown). There is also a hole 32' in the support 5' for the connecting terminal 7B' of the insulation-piercing connector to pass through. The connecting terminal 7B', which is in the form of a pin, is carried by a block 7A' which incorporates a conduit for a conductor member 28' connecting it electrically to the slider member of the insulation-piercing connector. This conduit is off-center relative to the terminal 7B' in the block 7A' to which it is crimped. The conductor member 28' extends along the pin 7B' to a center connecting member 33' of the coaxial connector, which is either a plug as shown here or a socket. The connecting member 33' comprises, for example, a conventional housing for a conductor member 28' end into which the latter can be soldered or possibly crimped.

A positioning bush 34' of electrically insulative material surrounds the conductor member 28' between the base member 2' of the insulation-piercing connector and the center connecting member 33' which fits over it. This positioning bush is immobilized by a sleeve 35' which forms the cylindrical outer conductor of the coaxial plug, which comprises bayonet type coupling members 36'. To this end the cylindrical outer conductor 35' is screwed concentrically with the center connecting member 33' to a fixing bush 37' which is held against the base member 2' by the support 5'; this bush is immobilized concentrically with the connecting terminal 7' by clamping an end flange 37A' on it into a circular groove around the holes in the support 5', through which said bush passes.

The fixing bush 37' and the cylindrical outer conductor 35' are preferably made from a metal that is a good electrical conductor, as is the support 5' in order to serve as a ground connection, the support 5' being connected to the connecting spikes 16' of the insulation-piercing connector.

Figure 9:
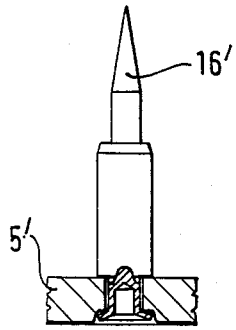
FIG. 9 shows one way of fixing a connecting spike for the connector shown in FIG. 8.

The connecting spikes 16' are plugged into the base member 2' and crimped at the end into the support 5', as seen in FIG. 9.

A hollow cylindrical insulative filling 38' is fixed, by overmolding, for example, to the interior of the end of the cylindrical outer conductor 35' (FIG. 8) to locate around the center connecting member 33' which it surrounds and presses onto the bush 34'. This filling holds the center connecting member in place and its central cavity enables insertion of a center connecting member complementary to the member 33' forming part of a complementary coaxial connector (not shown), in this instance a socket.

It is of course possible to attach an insulation-piercing connector in precisely the same way to either a conventional coaxial plug or a conventional coaxial socket for connecting a coaxial cable or equipment by means of a complementary socket or plug (not shown).

There is claimed:

1. Insulation-piercing connector for coaxial cables directly positionable on a support on equipment to be served by the coaxial cable or on a plug or socket attached to the coaxial cable either before or after the connection is made to the coaxial cable, said connector comprising a base member and a complementary bracket member together defining a conduit for said coaxial cable, said base member and said bracket member being separable at a first surface of said base member to fit around said coaxial cable and to be clamped together to immobilize said coaxial cable in said conduit, said base member being attachable to a support, and having a second, bearing surface on said base member for bearing on said support when said base member is attached to said support, terminals on said base member projecting beyond said bearing surface, connecting spikes projecting from said base member adapted to pierce said coaxial cable and to connect inner and outer conductors of said coaxial cable to respective terminals, a guide transverse to said conduit and opening into said conduit and externally of said base member in which said connecting spike adapted to connect said inner conductor of said coaxial cable to the respective terminal is removably housed, and an inner conductor connecting spike locating guide on said base member disposed obliquely to said bearing surface and opening externally of said base member opposite said bearing surface and laterally of said bracket member, whereby said inner conductor connecting spike is insertable and removable even when said connector is attached to said support by said base member.

2. Connector according to claim 1, wherein said inner conductor connecting spike positioning guide opens externally of said connector in a first part of said base member remote from said support and laterally relative to said bracket member and wherein a second part of said base member immobilizes said cable, and said connector further comprising maneuverable immobilizing members on said first part of said base member by which said bracket member is fixed to said base member.

3. Connector according to claim 1, further comprising a conductor conduit in said base member aligned with said inner conductor connecting spike positioning guide and extending towards said bearing surface outside said cable immobilizing conduit and a conductor member connecting said inner conductor connecting spike to the respective terminal.

4. Connector according to claim 1, wherein said inner conductor connecting spike positioning guide opens laterally into said cable immobilizing conduit outside the part thereof covered by said bracket member.

5. Connector according to claim 1, further comprising a coaxial plug or socket associated with said base member and having its inner and outer contacts connected to respective terminals on said base member.

6. Connector according to claim 1, further comprising a slideway at the base of said positioning guide, a slider member movable in translation in said slideway, a screwthread on said slider member adapted to receive said inner conductor connecting spike, which has a complementary screwthread, a spring adapted to urge said slider member towards the base of said slideway, a tubular abutment member immobilized in said positioning guide above said spring and towards the exterior of said base member, said spring bearing at one end on said slider member and at the other end on said abutment member, a cylindrical head on said inner conductor connecting spike passing through said abutment member and surrounded by said spring, and operating coupling means at one end of said cylindrical head, the end of said inner conductor connecting spike opposite said cylindrical head projecting into said cable immobilizing conduit when said inner conductor connecting spike is fitted to said positioning guide.

7. Connector according to claim 6, further comprising a flexible braided conductor member connected to said slider member and to the terminal corresponding to said inner conductor connecting spike, whereby said inner conductor connecting spike is electrically connected to the corresponding terminal by said slider member and said conductor member.

8. In combination, an insulation-piercing connector for coaxial cables positioned on a support on equipment being served by the coaxial cable or a plug or socket attached to the coaxial cable either before or after the connection is made to the coaxial cable, said connector comprising a base member and a complementary bracket member together defining a conduit for said coaxial cable, said base member and said bracket member being separable at a first surface of said base member to fit around said coaxial cable and clamped together to immobilize said coaxial cable in said conduit, said base member being attached to said support at a second, bearing surface on said base member bearing on said support, terminals on said base member projecting beyond said bearing surface, connecting spikes projecting from said base member adapted to pierce said coaxial cable and to connect inner and outer conductors of said coaxial cable to respective terminals, a guide transverse to said conduit and opening onto said conduit and externally of said base member in which said connecting spike adapted to connect said inner conductor of said coaxial cable to the respective terminal is removably housed, and an inner conductor connecting spike locating guide on said base member disposed obliquely to said bearing surface and opening externally of said base member beyond said bearing surface and laterally of said bracket member, whereby said inner conductor connecting spike is insertable and removable even when said connector is connected to said support by said member.

* * * * *